US010018203B2

(12) United States Patent
Takahashi et al.

(10) Patent No.: US 10,018,203 B2
(45) Date of Patent: Jul. 10, 2018

(54) AL ALLOY CAST IMPELLER FOR COMPRESSOR AND PROCESS FOR PRODUCING SAME

(71) Applicant: UACJ Corporation, Tokyo (JP)

(72) Inventors: Koichi Takahashi, Tokyo (JP); Toshio Ushiyama, Tokyo (JP)

(73) Assignee: UACJ Corporation (JP)

( * ) Notice: Subject to any disclaimer, the term of this patent is extended or adjusted under 35 U.S.C. 154(b) by 394 days.

(21) Appl. No.: 14/436,277

(22) PCT Filed: Aug. 28, 2013

(86) PCT No.: PCT/JP2013/005067
§ 371 (c)(1),
(2) Date: Apr. 16, 2015

(87) PCT Pub. No.: WO2014/064876
PCT Pub. Date: May 1, 2014

(65) Prior Publication Data

US 2016/0245296 A1 Aug. 25, 2016

(30) Foreign Application Priority Data

Oct. 26, 2012 (JP) ..... 2012-236226

(51) Int. Cl.
*F04D 29/28* (2006.01)
*C22F 1/057* (2006.01)
(Continued)

(52) U.S. Cl.
CPC ..... *F04D 29/28* (2013.01); *B22C 9/22* (2013.01); *B22D 17/005* (2013.01);
(Continued)

(58) Field of Classification Search
CPC ..... F04D 29/02; F04D 29/023; F04D 29/028; B22C 9/22; B22D 17/005; B22D 21/007;
(Continued)

(56) References Cited

U.S. PATENT DOCUMENTS 1,876,073 A * 9/1932 Player ..... B22D 15/02 164/121
4,556,548 A 12/1985 Gradl et al.

FOREIGN PATENT DOCUMENTS

CN 1740364 3/2006
EP 1 557 567 7/2005
(Continued)

*Primary Examiner* — Jason Shanske
*Assistant Examiner* — Alexander White
(74) *Attorney, Agent, or Firm* — Jordan and Koda, PLLC

(57) ABSTRACT

An aluminum alloy cast impeller has a stable high-temperature strength (e.g., 0.2% proof stress value of 260 MPa or more) at about 200° C. A boss part, blade parts, and a disc part have secondary dendrite arm spacings of 20 to 50 μm, 10 to 35 μm, and 5 to 25 μm, respectively, and satisfy the relationship Amax>Bmax>Cmax, where Amax, Bmax, and Cmax are the maximum values of the secondary dendrite arm spacings of the boss part, the blade parts, and the disc part, respectively. During casting, Al alloy molten metal is pressure injected into a 200 to 350° C. plaster mold. A 100 to 250° C. chill occurs on a surface in contact with an impeller disc surface, so that the chill temperature (° C.)< (plaster mold temperature−50° C.).

4 Claims, 1 Drawing Sheet

(51) Int. Cl.

| | |
|---|---|
| ***C22C 21/16*** | (2006.01) |
| ***F04D 29/02*** | (2006.01) |
| ***B22D 21/00*** | (2006.01) |
| ***B22D 25/02*** | (2006.01) |
| ***B22D 17/00*** | (2006.01) |
| ***C22C 21/18*** | (2006.01) |
| ***C22C 21/14*** | (2006.01) |
| ***B22C 9/22*** | (2006.01) |
| ***B22D 27/04*** | (2006.01) |
| ***C22C 21/08*** | (2006.01) |
| *C22F 1/00* | (2006.01) |
| *F02B 33/40* | (2006.01) |

(52) U.S. Cl.
CPC ..... *B22D 21/007* (2013.01); *B22D 25/02* (2013.01); *B22D 27/045* (2013.01); *C22C 21/08* (2013.01); *C22C 21/14* (2013.01); *C22C 21/16* (2013.01); *C22C 21/18* (2013.01); *C22F 1/057* (2013.01); *F04D 29/023* (2013.01); *C22F 1/00* (2013.01); *F02B 33/40* (2013.01)

(58) Field of Classification Search
CPC ..... B22D 25/02; B22D 27/045; C22C 21/08; C22C 21/14; C22C 21/16; C22C 21/18; C22F 1/00; C22F 1/057; F02B 33/40; F05B 2230/21; F05B 2230/211; F05B 2230/40; F05B 2280/1021; F05B 2280/1073; F05B 2280/6005; F05B 2280/6009
See application file for complete search history.

(56) References Cited

FOREIGN PATENT DOCUMENTS

| | | | | |
|---|---|---|---|---|
| EP | 2 036 993 | | | 3/2009 |
| JP | 7-126789 | | | 5/1995 |
| JP | 10-58119 | | | 3/1998 |
| JP | 10-212967 | | | 8/1998 |
| JP | 11-343858 | | | 12/1999 |
| JP | 2005-206927 | | | 8/2005 |
| JP | 2008-111153 | | | 5/2008 |
| JP | 2010-053743 | | | 3/2010 |
| JP | 2010-163644 | | | 7/2010 |
| JP | 2012-025986 | | | 2/2012 |
| JP | 2012025986 | A | * | 2/2012 |
| WO | WO-2008/001758 | | | 1/2008 |

* cited by examiner

AL ALLOY CAST IMPELLER FOR COMPRESSOR AND PROCESS FOR PRODUCING SAME

TECHNICAL FIELD

The present invention relates to an aluminum alloy cast impeller for compressors for use in turbochargers of the internal combustion engines of automobiles and ships, and to a method for producing the same.

BACKGROUND OF THE INVENTION

The turbochargers used for the internal combustion engines of automobiles and ships include a compressor impeller that compresses and supplies air into the internal combustion engine by rotating at high speed. The compressor impeller can reach temperatures as high as about 150° C. during its high-speed rotation, and receives high stress, such as the torsional stress from the rotating shaft, and the centrifugal force, near the center of rotation, particularly at the disc portion.

Various materials are used for the compressor impeller according to the required performance of the turbocharger. Hot forged materials of an aluminum alloy machined into an impeller shape are typically used in large-scale applications such as ships. Mass production efficiency and costs are more important in relatively smaller applications such as in automobiles (e.g., cars, and trucks), and boats. Such applications commonly use easily castable aluminum alloys of primarily silicon additive such as JIS-AC4CH (Al—7% Si—0.3% Mg alloy), ASTM-354.0 (Al—9% Si—1.8% Cu—0.5% Mg alloy), and ASTM-C355.0 (Al—5% Si—1.3% Cu—0.5% Mg alloy) of desirable castability. These materials are then cast with a plaster mold by using techniques such as low-pressure casting, vacuum casting, and gravity casting, and are strengthened by a solution treatment or an aging treatment before use. A basic method of such procedures is disclosed in detail in Patent Document 1.

Lately, the need for high-speed turbochargers has increased with the increase in the demand for higher compression ratios of air necessitated by smaller engines, higher output, and increased exhaust recirculation. However, faster rotation speeds increase the amount of heat generated by air compression, and at the same time increase the temperature of the exhaust turbine impeller. This heat is conducted to increase the temperature of the compressor impeller. It has been found that conventional compressor impellers made of easily castable aluminum alloys of primarily silicon additive tend to cause problems such as deformation and fatigue failure during use, and fail to keep rotating normally. Specifically, these existing compressor impellers have an operating temperature of at most about 150° C., and there is a strong need for the development of a compressor impeller that can withstand an operating temperature of about 200° C. to meet the demand for high speed rotations.

It may be possible to use an aluminum alloy composition of more desirable high-temperature strength, for example, such as JIS-AC1B (Al—5% Cu—0.3% Mg alloy). However, as described in Patent Document 2, the problem of such an alloy is that the molten metal lacks desirable fluidity, and tends to cause misruns (underfilling) of the molten metal in thin portion of blade parts when used to make articles that have complex shapes and thin blade parts such as in compressor impellers.

Patent Document 2 addresses this problem by proposing a method that uses an Al—Si easily castable alloy such as AC4CH for the blade part for which misruns of a molten metal are of concern, and an Al—Cu high-strength alloy such as AC1B for the boss and disc parts that are connected to the rotating shaft and thus require strength. These are coalesced by being poured in two separate portions to form a compressor impeller.

Patent Document 3 proposes a method that uses an alloy of desirable castability for the blade part, and in which a strengthened composite material prepared by impregnating a strengthening material such as a 25%-B (boron) aluminum whisker with aluminum is used for the stressed boss portion and the central portion of the disc part. These are then joined to each other to form a compressor impeller.

Patent Document 4 proposes a method in which a blade part and a boss part (and a disc part) are joined to each other by friction welding. However, methods such as this that use different materials for different parts are problematic in terms of productivity and cost, and are currently not usable in industrial applications.

Patent Document 5 addresses the problem of using different materials by proposing a compressor impeller that can be cast from a single alloy, specifically an Al—Cu—Mg-base alloy for which the additive elements and the combination range of these elements are optimized. The resulting compressor impeller has a proof stress value of 250 MPa or more at 180° C. Patent Document 6 proposes improving the casting yield by controlling the crystal grain size of an Al—Cu—Mg-base alloy through optimization of the additive elements and the combination range of these elements. The compressor impeller has a proof stress value of 260 MPa or more at 200° C.

However, a problem remains that the products of the single alloy casting using the Al—Cu—Mg-base alloy still, need to stably withstand high temperatures in the vicinity of 200° C. over extended time periods if these were to be used for ever faster turbochargers. Another unsolved problem is that the casting yield needs to be improved for stable production.

CITATION LIST

Patent Document 1: U.S. Pat. No. 4,556,528
Patent Document 2: JP-A-10-58119
Patent Document 3: JP-A-10-212967
Patent Document 4: JP-A-11-343858
Patent Document 5: JP-A-2005-206927
Patent Document 6: JP-A-2012-25986

SUMMARY OF THE INVENTION

The present invention has been made in view of the foregoing problems, and it is an object of the present invention to provide an aluminum alloy (hereinafter, "Al alloy") cast impeller for compressors that remains stably strong over extended time periods even under operating temperatures of about 200° C., and that excels in productivity. The invention is also intended to provide a method for producing such impellers.

A feature of the present invention lies in an Al alloy cast impeller for compressors comprising a boss part, a plurality of blade parts, and a disc part, wherein the Al alloy casting comprises an Al alloy that contains Cu: 1.4 to 3.2 mass %, Mg: 1.0 to 2.0 mass %, Ni: 0.5 to 2.0 mass %, Fe: 0.5 to 2.0 mass %, and Ti: 0.01 to 0.35 mass %, the balance of Al and unavoidable impurities, wherein the boss part has a secondary dendrite arm spacing of 20 to 50 μm, the blade parts have a secondary dendrite arm spacing of 10 to 35 μm, and the disc part has a secondary dendrite arm spacing of 5 to 25 μm, wherein the boss part, the blade parts, and the disc part satisfy the relationship Amax>Bmax>Cmax, where Amax is the maximum value of the secondary dendrite arm spacing of the boss part, Bmax is the maximum value of the secondary dendrite arm spacing of the blade parts, and Cmax is the maximum value of the secondary dendrite arm spacing of the disc part, and wherein the Al alloy cast impeller for compressors has a 0.2% proof stress value of 260 MPa or more at 200° C.

Another feature of the present invention is that the Al alloy cast impeller for compressors is for use in large-scale applications, and wherein the boss part measures 200 to 80 mm in height, the disc part measures 300 to 100 mm in diameter, and the blade parts have 30 to 10 blades measuring 180 to 60 mm in height and measuring 4.0 to 0.4 mm in thickness at a blade tip.

Another feature of the present invention is that the Al alloy cast impeller for compressors is for use in small-scale applications, and wherein the boss part measures 100 to 20 mm in height, the disc part measures 120 to 25 mm in diameter, and the blade parts have 20 to 4 blades measuring 90 to 5 mm in height and measuring 3.0 to 0.1 mm in thickness at a blade tip.

Still another feature of the present invention is a method for producing the Al alloy cast impeller for compressors according to any one of claims 1 to 3, the method comprising:

a molten metal preparation step to preparing a 720 to 780° C. Al alloy molten metal that contains Cu: 1.4 to 3.2 mass %, Mg: 1.0 to 2.0 mass %, Ni: 0.5 to 2.0 mass %, Fe: 0.5 to 2.0 mass %, and Ti: 0.01 to 0.35 mass %, the balance of Al and unavoidable impurities;

a casting step to casting an Al alloy casting by pressure casting whereby the Al alloy molten metal prepared is pressure injected into a product shape space configured from a 200 to 350° C. plaster mold and a 100 to 250° C. chill disposed on a surface in contact with an impeller disc surface, the plaster mold temperature and the chill temperature satisfying the relationship chill temperature (° C.)< (plaster mold temperature−50) (° C.);

a solution treatment step to subjecting the Al alloy casting to a solution treatment; and an aging treatment step to subjecting the Al alloy casting to an aging treatment after the solution treatment.

The present invention can provide an aluminum alloy cast impeller for compressors that shows stable high-temperature strength even in a high temperature range in the vicinity of 200° C. over extended time periods, and that has excellent productivity such as casting yield.

DESCRIPTION OF THE PREFERRED EMBODIMENTS

An embodiment of the present invention is described below in detail.

A. Shape of Al Alloy Cast Impeller for Compressors

Figure 1:
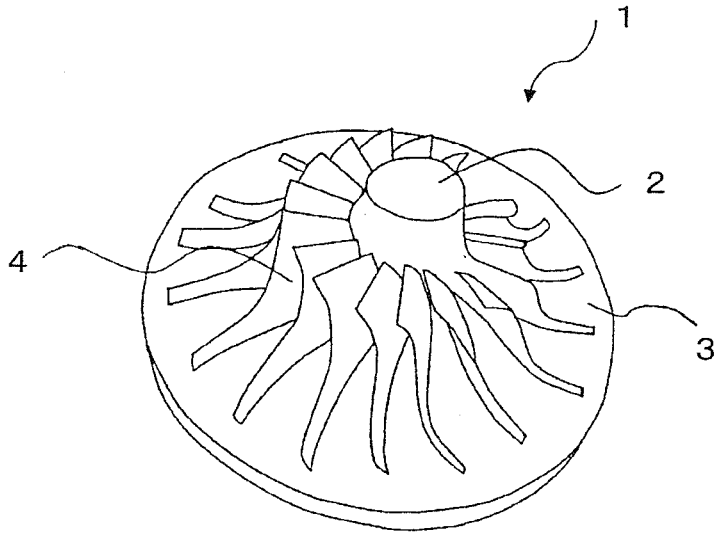
FIG. 1 is a perspective view representing an exemplary structure of an Al alloy cast impeller for compressors according to the present invention.

FIG. 1 shows an example of the shape of the aluminum alloy cast impeller for compressors (hereinafter, simply "compressor impeller") according to the present embodiment. A compressor impeller 1 includes a rotational center shaft (boss part) 2, a disc part 3 continuous from the boss part 2, and a plurality of thin blades 4 projecting outwardly from the disc part 3. The compressor impeller 1 reaches a temperature as high as about 200° C. during high-speed rotation, and receives high stress, such as the torsional stress from the rotating shaft, and the centrifugal force, near the center of rotation, particularly at the disc part and the blade parts.

The present inventors conducted intensive studies to solve the foregoing problems, and found that the casting yield significantly improves, and a compressor impeller that can stably maintain desirable high-temperature strength over extended time periods without causing damage to the disc and blade parts even under high operating temperatures of about 200° C. can be obtained with the use of an aluminum alloy by controlling the casting cooling rate distribution, and optimizing the secondary dendrite arm spacing distribution inside the compressor impeller.

As used herein, "stably maintain desirable high-temperature strength over extended time periods" means that deformation and fatigue failure do not occur over extended time periods even under operating temperatures of about 200° C. Specifically, it means that the 0.2% proof stress value obtained in a 200° C. tensile test is 260 MPa or more, and that no damage occurs in a turbo assembly durability test conducted at 200° C. for 150,000 rpm×200 hours.

B. Secondary Dendrite Arm Spacing

The aluminum alloy used in the present invention is cast into a shape of the compressor impeller with a plaster mold by pressure casting (low-pressure casting, vacuum casting, or differential pressure casting) according to a conventional Al—Si aluminum alloy casting producing method.

The pressure casting using a plaster mold requires controlling solidification conditions so that the maximum secondary dendrite arm spacing inside the casting becomes 25 μm or less in the disc part, 35 μm or less in the blade parts, and 50 μm or less in the boss part. This is to prevent the fatigue failure due to the stress that repeatedly generates as the compressor impeller accelerates and decelerates in its rotation. When the secondary dendrite arm spacing values exceed the foregoing limits in these parts, fatigue cracking tends to occur and progress along the intermetallic compounds that are linearly distributed along the coarse dendrite arm boundaries. Particularly, the upper limits of the dendrite arm spacing of the disc part and the blade parts need to be smaller than the upper limit of the dendrite arm spacing of the boss part because the thickness of the disc and blade parts are thinner than the boss part, and receive tensile stress under the rotation. The disc part also receives the torsional stress from the blade parts, and needs to have a smaller upper limit of dendrite arm spacing than the blade parts. Note that dendrites are branching solid-phase metal that forms as the metal solidifies, and the portions branching out of the stems of these branches are called secondary dendrite arms.

Cooling rate needs to be increased to reduce the secondary dendrite arm spacing. However, an excessively short solidification time with an increased cooling rate makes the casting riser effect ineffective in the solidification process, and tends to increase the shrinkage cavity due to solidification shrinkage, and adversely affect the dimensional accuracy. Particularly, a reasonable amount of solidification time is needed to ensure sufficient casting yield and dimensional accuracy for a casting of a thin complex shape such as a compressor wheel. Specifically, the cooling rate needs to be adjusted to make the secondary dendrite arm spacing at least 20 μm for the boss part, at least 10 μm for the blade parts, and at least 5 μm for the disc part.

C. Controlling Cooling Rate

In order to obtain the secondary dendrite arm spacing distribution above, it is necessary to control the temperature of the molten metal pressure injected into the plaster mold, and the cooling rate inside the compressor wheel. The molten metal needs to be adjusted to a temperature of 720 to 780° C. The cooling rate inside the compressor wheel can be controlled through optimization of the chill (chill plate) temperature, the preheating temperature of the plaster mold, and the casting temperature. Specifically, a metal chill with the adjusted temperature of 100 to 250° C. needs to be disposed on the surface in contact with the disc surface, and the plaster mold needs to have a preheating temperature of 200 to 350° C. The secondary dendrite arm spacing ranges of 20 μm to 50 μm for the boss part, 10 μm to 35 μm for the blade parts, and 5 μm to 25 μm for the disc part can be achieved by setting the temperatures of the molten metal, the chill, and the plaster mold as above.

When the molten metal temperature is below 720° C., the pressure injected molten metal solidifies early inside the product shape space. This causes misruns, and the intended product shape cannot be obtained. On the other hand, with a molten metal temperature above 780° C., the molten metal progressively undergoes oxidation, and the absorption of hydrogen gas and the increased oxide impairs the quality of the molten metal. This makes it difficult to ensure product strength. When the preheating temperature of the plaster mold is less than 200° C., solidification takes place before the charged molten metal reaches the mold end. This causes misruns, and the intended product shape cannot be obtained. On the other hand, when the preheating temperature of the plaster mold exceeds 350° C., the solidification slows down inside the plaster mold, and a shrinkage cavity failure occurs. When the chill temperature is below 100° C., solidification becomes excessively fast, and causes misruns. On the other hand, when the chill temperature exceeds 250° C., the rate of solidification from the chill becomes slower, and a shrinkage cavity failure occurs.

The chill material is preferably copper or a copper alloy, which has high thermal conductivity. However, materials such as steel, and stainless steel also may be used. Preferably, the chill temperature is adjusted by using a mechanism by which superheating in the casting is reduced with a coolant such as water passed inside the chill.

D. Relationship Between Maximum Values of Secondary Dendrite Arm Spacing of Different Parts The order in which solidification takes place inside the compressor wheel is important to reduce internal defects due to shrinkage cavity and to improve the casting yield. The shrinkage cavity defects in the boss part and the disc part can be prevented by causing the solidification to take place unidirectionally toward the boss part from the disc part in contact with the chill. In order to prevent the shrinkage cavity defect in the blade parts, the solidification at the blade parts must complete before the boss part solidifies. Specifically, solidification must take place in order from the disc part, the blade parts, and to the boss part.

Because the secondary dendrite arm spacing becomes the largest in a part that solidifies the last, it is desirable to satisfy the relationship Amax>Bmax>Cmax so that the disc part, the blade parts, and the boss part solidify in this order. Here, Amax is the maximum value of the secondary dendrite arm spacing of the boss part, Bmax is the maximum value of the secondary dendrite arm spacing of the blade parts, and Cmax is the maximum value of the secondary dendrite arm spacing of the disc part. This relationship can be satisfied by making the chill temperature less than a temperature that is 50° C. lower than the plaster mold temperature. When the chill temperature is lower than the plaster mold temperature by 50° C. or greater temperatures, the blade parts solidify before the disc part that is closer to the chill, and the foregoing relationship Amax>Bmax>Cmax cannot be obtained.

E. Al Alloy Composition

The composition of the Al alloy used in the present invention is described below along with the reasons for limiting the Al alloy components.

Cu and Mg:

Cu and Mg dissolve into the Al matrix and show an effect that a mechanical strength is improved by the solid solution strengthening. By existing together, Cu and Mg also contribute to improving strength through precipitation strengthening such as by $Al_2Cu$, and $Al_2CuMg$. Because these two elements widen the solidification temperature range, excess addition of these elements is detrimental to castability.

When the Cu content is less than 1.4 mass % (hereinafter, simply "%"), and/or Mg content is less than 1.00%, the required mechanical strength at high temperatures of around 200° C. may not be obtained with a. On the other hand, when the Cu content is above 3.2%, and/or Mg content is in excess of 2.0%, the castability of the compressor impeller is impaired, and may cause an underfill as the molten metal fails to sufficiently run into the blade end portion in particular. For these reasons, the Cu content should preferably be 1.4 to 3.2%, and the Mg content should preferably be 1.0 to 2.0%. The Cu content is more preferably 1.7 to 2.8%, and the Mg content is more preferably 1.3 to 1.8% in terms of surely preventing defects such as deformation during use, and practically preventing generation of an underfill during casting and obtaining an industrially preferable yield.

Ni and Fe:

Ni and Fe disperse into the Al matrix by forming an intermetallic compound with Al, and show an effect to improve the high-temperature strength of the Al alloy. To this end, the Ni content should preferably be 0.5% or more, and the Fe content should preferably be 0.5% or more. However, when contained in excess, these elements not only coarsen the intermetallic compound, but reduce the amount of the solid solution Cu in the Al matrix, and lower strength by forming $Cu_2FeAl_7$ and $Cu_3NiAl_6$ at high temperatures. It is therefore preferable to contain Ni and Fe in 2.0% or less each. Taken together, the Ni content should preferably be 0.5 to 2.0%, and the Fe content should preferably be 0.5 to 2.0%. More preferably, the Ni content is 0.5 to 1.4%, and the Fe content is 0.7 to 1.5%. The lower limits of these preferred ranges are provided as indications for stably mass producing products in industrial settings taking into account possible production variation, whereas the upper limits are indications above which the effects will be saturated, and the added materials will be wasted.

Ti:

Ti has the effect to inhibit the growth of primary phase aluminum crystal grains during casting. The element is thus added to reduce the size of the solidification structure in the casting, and improve the supply and the run of the molten metal. This effect may become insufficient when the Ti content is less than 0.01%. On the other hand, a Ti content above 0.35% causes formation of coarse intermetallic compounds with Al of several ten to several hundred micrometers. These compounds can become the origin of fatigue cracking during rotation, and may lower the reliability of the compressor impeller. For these reasons, the Ti content should preferably be 0.01 to 0.35%, more preferably 0.02 to 0.30%.

The Al alloy may contain unavoidable impurities, such as about 0.3% or less of Si, and about 0.2% or less of Zn, Mn, and Cr. These unavoidable impurities are acceptable because these do not affect the characteristics of the compressor impeller.

The compressor impeller according to the present invention maintains stable strength over extended time periods even under operating temperatures of about 200° C. Specifically, a 0.2% proof stress value of 260 MPa or more is specified in a 200° C. tensile test. The proof stress value is preferably 265 MPa or more. The upper limit of proof stress value is intrinsically determined by the aluminum base alloy composition, and production conditions. In the present invention, the upper limit of proof stress value is 380 MPa.

F. Producing Method

A method for producing the Al alloy cast impeller for compressors according to the present invention is described below. The producing method includes a molten metal adjusting step, a casting step, and a heat treatment step.

Molten Metal Adjusting Step:

Each component element is melted under heat in the Al alloy composition above by using an ordinary method, and molten metal processes such as processing of dehydrogenated gas, and removal of inclusions are performed. The temperature is adjusted to make the final molten metal temperature 720 to 780° C.

Casting Step:

In the casting step, the molten metal adjusted to 720 to 780° C. is cast into a shape of the compressor impeller by pressure casting using a plaster mold. As described above, the temperature of the chill disposed on the surface in contact with the disc surface is adjusted to 100° C. to 250° C., and the preheating temperature of the plaster mold is adjusted to 200 to 350° C. Here, the molten metal is pressure injected into the plaster mold under the pressure of typically 0.01 to 0.4 MPa. However, the pressure inside the plaster mold may be reduced by 0.01 to 0.4 MPa.

Heat Treatment Step:

The Al alloy casting is subjected to a heat treatment step. The heat treatment step includes a solution treatment step and an aging treatment step. The heat treatment step can effectively take advantage of the solid solution strengthening by Cu; the precipitation strengthening by Cu and Mg; and the dispersion strengthening by the intermetallic compounds formed between Al and Fe and between Al and Ni.

Solution Treatment Step:

The solution treatment is performed preferably in a temperature range that is 5 to 25° C. lower than the solidus temperature. In the preferred Al alloys for use in the present invention, a temperature range of 510 to 530° C. represents such a temperature range that is 5 to 25° C. lower than the solidus temperature. The risk of melting the second phase of crystal grain boundaries increases, and it becomes difficult to ensure strength at temperatures above the temperature range that is 5 to 25° C. lower than the solidus temperature. On the other hand, the elements do not diffuse sufficiently, and the solution treatment becomes insufficient at temperatures below the temperature range that is 5 to 25° C. lower than the solidus temperature.

Aging Treatment:

The aging treatment involves a heat treatment performed preferably at 180 to 230° C. for 3 to 30 hours, more preferably 190 to 210° C. for 5 to 20 hours. The precipitation strengthening for improving strength may become insufficient when the process temperature is below 180° C., or when the process time is less than 3 hours. On the other hand, the precipitated phase formed may coarsen (overaging), and may fail to provide a sufficient strengthening effect, and the solid solution strengthening capability of Cu weakens when the process temperature exceeds 230° C., or when the process time exceeds 30 hours.

G. Shape of Compressor Wheel

The shape and the dimensions of the compressor impeller according to the present invention, and the number of blades of the compressor impeller are not particularly limited, and the compressor impeller is applicable to many different applications, ranging from large-scale applications such as ships to small-scale applications such as automobiles. Taking a large scale application such as ships as an example, the boss part has a height of 200 to 80 mm, preferably 180 to 100 mm, the disc part has a diameter of 300 to 1.00 mm, preferably 260 to 120 mm, and the blade parts have a height of 180 to 60 mm, preferably 160 to 90 mm. The thickness at the tip of the blade is 4.0 to 0.4 mm, preferably 3.0 to 0.6 mm. The number of blades is 30 to 10, preferably 26 to 12. In the case of smaller applications such as automobiles, the boss part has a height of 100 to 20 mm, preferably 90 to 25 mm, the disc part has a diameter of 120 to 25 mm, preferably 100 to 30 mm, and the blade parts have a height of 90 to 5 mm, preferably 80 to 8 mm. The thickness at the tip of the blade is 3.0 to 0.1 mm, preferably 2.0 to 0.2 mm. The number of blades is 20 to 4, preferably 18 to 6.

EXAMPLES

The present invention is described below in greater detail using Examples.

First Example (Present Examples 1 to 5, and Comparative Examples 1 to 16)

Each Al alloy of the composition shown in Table 1 was melted by using a common molten metal process, and the molten metal was adjusted to the temperature shown in Table 1 by a molten metal preparation step. In the molten metal preparation step, 150 kg of the Al alloy of the composition shown in Table 1 was melted to obtain a molten metal. Thereafter, argon gas was blown into the molten metal for 20 minutes with a rotary gas blower operated at a rotation speed of 400 rpm, and a gas flow rate of 2.5 $Nm^3/h$. The whole molten metal was held still for 1 hour to remove the slag.

TABLE 1

| | Composition (mass %) | | | | | | | | | | Casting conditions | | | Heat treatment conditions | |
|---|---|---|---|---|---|---|---|---|---|---|---|---|---|---|---|
| | | | | | | | | | | | | | | Solution treatment | Aging treatment |
| | | | | | | | | | | | Molten metal temperature | Plaster temperature | Chill temperature | temperature × time | temperature × time |
| No. | Cu | Mg | Ni | Fe | Ti | Si | Zn | Mn | Cr | Al | (° C.) | (° C.) | (° C.) | (° C. × h) | (° C. × h) |
| Present Example 1 | 3.2 | 2.0 | 1.9 | 2.0 | 0.10 | 0.3 | 0.1 | 0.1 | 0.2 | Balance | 760 | 290 | 210 | 530 × 8 | 200 × 20 |
| Present Example 2 | 3.1 | 1.9 | 1.4 | 1.5 | 0.20 | 0.3 | 0.2 | 0.2 | 0.2 | | 780 | 345 | 250 | | |

TABLE 1-continued

| No. | Composition (mass %) Cu | Mg | Ni | Fe | Ti | Si | Zn | Mn | Cr | Al | Casting conditions: Molten metal temperature (° C.) | Plaster temperature (° C.) | Chill temperature (° C.) | Heat treatment conditions: Solution treatment temperature × time (° C. × h) | Aging treatment temperature × time (° C. × h) |
|---|---|---|---|---|---|---|---|---|---|---|---|---|---|---|---|
| Present Example 3 | 2.2 | 1.6 | 0.8 | 1.0 | 0.15 | 0.2 | 0.1 | 0.1 | 0.2 | | 760 | 205 | 110 | | |
| Present Example 4 | 1.6 | 1.4 | 0.6 | 0.7 | 0.35 | 0.2 | 0.2 | 0.0 | 0.0 | | 740 | 280 | 220 | | |
| Present Example 5 | 2.6 | 1.6 | 0.8 | 1.1 | 0.13 | 0.1 | 0.1 | 0.1 | 0.1 | | 750 | 210 | 130 | | |
| Com. Ex. 1 | 2.8 | 1.4 | 1.2 | 1.0 | 0.11 | 0.2 | 0.2 | 0.2 | 0.2 | | 780 | 360 | 220 | | |
| Com. Ex. 2 | 2.9 | 1.7 | 1.6 | 1.1 | 0.05 | 0.2 | 0.1 | 0.1 | 0.1 | | 770 | 300 | 260 | | |
| Com. Ex. 3 | 2.2 | 1.1 | 0.7 | 1.2 | 0.17 | 0.1 | 0.1 | 0.1 | 0.2 | | 750 | 180 | 140 | | |
| Com. Ex. 4 | 2.0 | 1.1 | 1.2 | 0.9 | 0.27 | 0.1 | 0.1 | 0.0 | 0.1 | | 740 | 210 | 90 | | |
| Com. Ex. 6 | 2.5 | 1.3 | 1.7 | 1.3 | 0.12 | 0.2 | 0.1 | 0.2 | 0.1 | | 790 | 270 | 200 | | |
| Com. Ex. 7 | 1.3 | 1.9 | 1.4 | 1.2 | 0.07 | 0.1 | 0.1 | 0.0 | 0.1 | | 730 | 250 | 180 | | |
| Com. Ex. 8 | 2.8 | 0.9 | 1.1 | 1.4 | 0.15 | 0.2 | 0.1 | 0.1 | 0.1 | | 750 | 230 | 190 | | |
| Com. Ex. 9 | 3.0 | 1.4 | 1.4 | 0.4 | 0.23 | 0.2 | 0.2 | 0.2 | 0.0 | | 760 | 240 | 170 | | |
| Com. Ex. 10 | 2.9 | 1.3 | 0.4 | 1.7 | 0.18 | 0.2 | 0.1 | 0.2 | 0.1 | | 770 | 260 | 200 | | |
| Com. Ex. 11 | 2.6 | 1.4 | 0.9 | 1.2 | 0.00 | 0.1 | 0.1 | 0.2 | 0.1 | | 765 | 250 | 210 | | |
| Com. Ex. 12 | 3.3 | 1.8 | 1.1 | 1.2 | 0.23 | 0.2 | 0.1 | 0.1 | 0.1 | | 740 | 255 | 185 | | |
| Com. Ex. 13 | 2.5 | 2.1 | 0.9 | 1.1 | 0.19 | 0.2 | 0.1 | 0.1 | 0.1 | | 750 | 225 | 150 | | |
| Com. Ex. 14 | 2.9 | 1.5 | 1.4 | 2.1 | 0.26 | 0.2 | 0.2 | 0.1 | 0.1 | | 730 | 275 | 225 | | |
| Com. Ex. 15 | 2.2 | 1.6 | 2.1 | 1.2 | 0.18 | 0.1 | 0.1 | 0.1 | 0.1 | | 760 | 245 | 190 | | |
| Com. Ex. 16 | 2.0 | 1.7 | 1.1 | 1.1 | 0.36 | 0.2 | 0.1 | 0.2 | 0.1 | | 750 | 250 | 200 | | |

The Al alloy molten metal prepared in the molten metal preparation step was then subjected to low-pressure casting to produce an Al alloy casting, whereby the molten metal was pressure injected into a predetermined space configured from a plaster mold that had been adjusted to the preheating temperature shown in Table 1, and a copper chill disposed on the surface in contact with the impeller disc surface and that had been adjusted to the temperature shown in Table 1. The Al alloy casting was intended as a turbocharger compressor impeller for cars, and had a shape with a boss part measuring 40 mm in height, a disc part measuring 40 mm in diameter, blade parts measuring 35 mm in height and having 12 blades that were 0.3 mm in thickness at the blade tip. The molten metal was injected under 100 kPa pressure. This pressure was applied until the whole Al alloy casting completely solidified.

The Al alloy casting was removed from the plaster mold, and subjected to a solution treatment at 530° C. for 8 hours, and thereafter to an aging treatment at 200° C. for 20 hours. In this way, a sample Al alloy cast impeller for compressors was prepared.

The samples prepared in such way were each evaluated for secondary dendrite arm spacing at the boss part, the blade parts, and the disc part, high temperature characteristics (0.2% proof stress value at 200° C., durability test evaluation), and productivity (casting yield evaluation), as follows.

1. Measurement of Secondary Dendrite Arm Spacing

Figure 2:
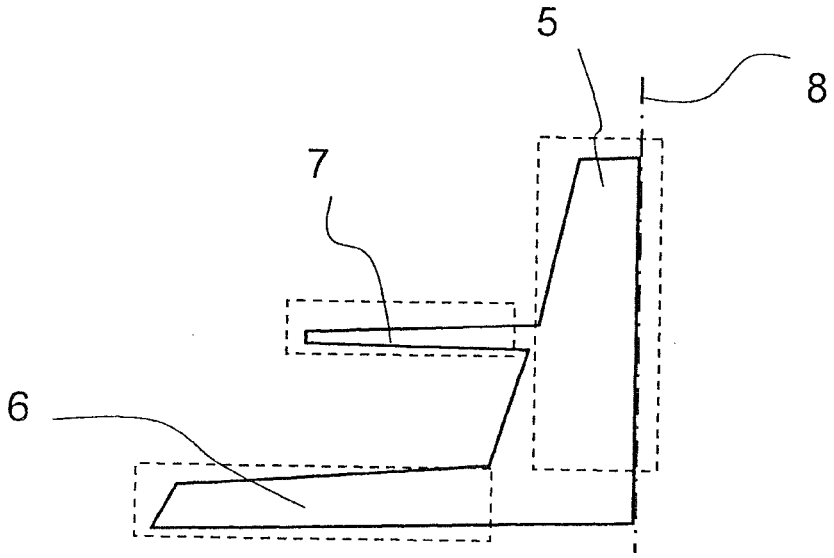
FIG. 2 is an explanatory diagram representing the DAS measurement areas inside the Al alloy cast impeller for compressors according to the present invention.

Secondary dendrite arm spacing (DAS) was measured according to the method described in *Aluminum Dendrite Arm Spacing and Cooling Rate Measurement Methods*, The Japan Institute of Light Metals, Research Sectional Meeting Report No. 20 (1988), pp. 46 to 52. Specifically, the sample was cut along a center line through the blade parts, and the cross section was polished. FIG. 2 represents a polished cross section on one side of the central shaft 8 of the compressor impeller. The polished cross section was observed for metal structures in a boss part DAS measurement cross section 5, a disc part DAS measurement cross section 6, and a blade part DAS measurement cross section 7 with a light microscope at 100× magnification, and secondary dendrite arm spacing was determined by using a cross-line method. The results are presented in Table 2. Observation was made at arbitrarily chosen 10 locations in each of the boss part, the disc part, and the blade parts. The numerical range of each port shown in Table 2 represents a range from the minimum value (the value on the left) to the maximum value (the value on the right) of the secondary dendrite arm spacing observed at 10 locations.

TABLE 2

| No. | Secondary dendrite arm spacing: Boss part (μm) | Blade part (μm) | Disc part (μm) | 0.2% proof stress value at 200° C. (MPa) | High-temperature durability test evaluation (Defect location)※1 | Productivity: Evaluation of casting yield | Proportion of products with internal failure (%) | Proportion of products with misruns (%) | Proportion of products with shrinkage cavity failure (%) |
|---|---|---|---|---|---|---|---|---|---|
| Present Example 1 | 25 to 41 | 15 to 29 | 11 to 19 | 281 | Good | Good | 1.0 | 0.3 | 0.8 |

TABLE 2-continued

| No. | Secondary dendrite arm spacing: Boss part (μm) | Secondary dendrite arm spacing: Blade part (μm) | Secondary dendrite arm spacing: Disc part (μm) | 0.2% proof stress value at 200° C. (MPa) | High-temperature durability test evaluation (Defect location)※1 | Productivity: Evaluation of casting yield | Productivity: Proportion of products with internal failure (%) | Productivity: Proportion of products with misruns (%) | Productivity: Proportion of products with shrinkage cavity failure (%) |
|---|---|---|---|---|---|---|---|---|---|
| Present Example 2 | 29 to 48 | 23 to 34 | 18 to 23 | 280 | Good | Good | 2.2 | 0.1 | 1.2 |
| Present Example 3 | 21 to 39 | 11 to 22 | 6 to 18 | 278 | Good | Good | 1.8 | 0.2 | 0.4 |
| Present Example 4 | 27 to 42 | 17 to 31 | 8 to 20 | 270 | Good | Good | 1.1 | 1.0 | 0.6 |
| Present Example 5 | 22 to 39 | 11 to 25 | 7 to 19 | 278 | Good | Good | 1.4 | 0.4 | 1.6 |
| Com. Ex. 1 | 35 to 55 | 32 to 42 | 19 to 25 | 241 | Poor (Blade part) | Acceptable | 2.0 | 0.5 | 4.5 |
| Com. Ex. 2 | 30 to 45 | 20 to 33 | 25 to 35 | 252 | Poor (Disc part) | Acceptable | 2.8 | 0.2 | 5.6 |
| Com. Ex. 3 | 18 to 32 | 10 to 29 | 17 to 25 | 266 | Good | Poor | 3.0 | 35.0 | 10.1 |
| Com. Ex. 4 | 28 to 44 | 13 to 24 | 4 to 14 | 263 | Acceptable (Disc part) | Poor | 4.2 | 46.5 | 3.4 |
| Com. Ex. 6 | 31 to 53 | 22 to 31 | 11 to 25 | 251 | Acceptable (Boss part) | Acceptable | 5.5 | 0.7 | 2.3 |
| Com. Ex. 7 | 25 to 39 | 19 to 28 | 11 to 22 | 240 | Poor (Disc part) | Good | 1.2 | 1.0 | 1.3 |
| Com. Ex. 8 | 24 to 40 | 15 to 25 | 9 to 19 | 242 | Acceptable (Boss part) | Good | 1.6 | 0.6 | 1.7 |
| Com. Ex. 9 | 22 to 41 | 13 to 28 | 10 to 21 | 249 | Acceptable (Blade part) | Good | 0.8 | 0.8 | 1.8 |
| Com. Ex. 10 | 28 to 36 | 11 to 23 | 8 to 16 | 243 | Poor (Disc part) | Good | 1.0 | 0.7 | 2.6 |
| Com. Ex. 11 | 30 to 47 | 20 to 32 | 15 to 22 | 275 | Poor (Blade part) | Poor | 3.5 | 37.0 | 13.5 |
| Com. Ex. 12 | 25 to 41 | 17 to 29 | 10 to 18 | 278 | Good | Poor | 2.1 | 50.3 | 6.3 |
| Com. Ex. 13 | 23 to 38 | 18 to 25 | 12 to 23 | 274 | Good | Poor | 1.6 | 47.1 | 7.1 |
| Com. Ex. 14 | 26 to 37 | 14 to 23 | 14 to 22 | 253 | Acceptable (Disc part) | Acceptable | 4.1 | 2.4 | 2.5 |
| Com. Ex. 15 | 25 to 40 | 22 to 30 | 8 to 18 | 259 | Acceptable (Boss part) | Acceptable | 2.6 | 2.3 | 3.3 |
| Com. Ex. 16 | 21 to 37 | 13 to 21 | 9 to 21 | 260 | Acceptable (Disc part) | Acceptable | 3.3 | 3.1 | 2.1 |

※1: 150,000 rpm × 200 hours, outlet temperature 200° C.

2. High Temperature Strength Characteristics

A round bar test piece (φ 8 mm) was obtained from the central shaft of each sample, and measured for 0.2% proof stress value in a 200° C. tensile test. The results are presented in Table 2.

3. High Temperature Durability

High-temperature fatigue strength was evaluated in a high-temperature durability test (turbo assembly; 150,000 rpm×200 h, outlet temperature 200° C.). The results are presented in Table 2. The durability test evaluation results in Table 2 followed the following notation.

Poor: Fractured

Acceptable: No fracture, but cracking is occurred

Good: No fracture or cracking, and the sample remained intact

The parentheses following Acceptable and Poor indicate the location of the occurred cracks and fractures.

4. Casting Yield Evaluation

Casting yield was evaluated for 1,000 samples produced in each Example. Each sample was tested for external appearance failure due to misruns and shrinkage cavity failure, and internal failure based on the detected internal blow holes in an X-ray examination. The proportions (%) of samples with misruns, shrinkage cavity failure, and internal failure in all samples were determined. The proportion (%) of non-defective products was then determined by subtracting the sum of the proportions of these defective products from the total 100%. The results are presented in Table 2.

Poor: The proportion of non-defective products is less than 90% (worse than in existing products)

Acceptable: The proportion of non-defective products is 90% or more and less than 95% (same as in existing products)

Good: The proportion of non-defective products is 95% to 100% (great improvement over existing products)

In Present Examples 1 to 5, the secondary dendrite arm spacings of the boss part, the blade parts, and the disc part, the order of solidification, and the high-temperature proof stress values all fell in the ranges set forth in claim 1. These products were thus excellent in terms of casting yield and high-temperature durability.

In contrast, in Comparative Example 1, the plaster temperature was high, and the boss part and the blade parts had large secondary dendrite arm spacings. The proof stress value was low accordingly. Further, damage occurred in the blade parts, and the high-temperature durability was poor.

In Comparative Example 2, the chill temperature was high, and the relationship chill temperature (° C.)<(plaster mold temperature−50) (° C.) was not satisfied. The secondary dendrite arm spacing of the disc part was large, and the relationship Amax>Bmax>Cmax was not satisfied. The proof stress value was low accordingly. Further, damage occurred in the disc part, and the high-temperature durability was poor.

In Comparative Example 3, the plaster mold temperature was low, and the relationship chill temperature (° C.)< (plaster mold temperature−50) (° C.) was not satisfied. The secondary dendrite arm spacing of the boss part was small. This led to multiple external appearance failures due to misruns in the blade parts, and the casting yield was considerably poor.

In Comparative Example 4, the chill temperature was low, and the disc part had small secondary dendrite arm spacing. This caused cracks in the disc part, and the high-temperature durability was poor. Further, the disc part had multiple external appearance failures due to misruns, and the casting yield was low.

In Comparative Example 6, the molten metal temperature was high, and the cooling rate in the boss part was low. Accordingly, the boss part had large secondary dendrite arm spacing. This resulted in a low proof stress value. Further, cracking occurred in the boss part, and the high-temperature durability was poor.

In Comparative Example 7, the Cu composition was small, and the proof stress value was low. Further, damage occurred in the disc part, and the high-temperature durability was poor.

In Comparative Example 8, the Mg composition was small, and the relationship chill temperature (° C.)<(plaster mold temperature−50) (° C.) was not satisfied. Accordingly, the proof stress value was low. Further, cracking occurred in the boss part, and the high-temperature durability was poor.

In Comparative Example 9, the Fe composition was small, and the proof stress value was low. Further, cracking occurred in the blade parts, and the high-temperature durability was poor.

In Comparative Example 10, the Ni composition was small, and the proof stress value was low. Further, cracking occurred in the disc part, and the high-temperature durability was poor.

In Comparative Example 11, the Ti composition was small, and the relationship chill temperature (° C.)<(plaster mold temperature−50) (° C.) was not satisfied. This caused damage in the blade parts, and the high-temperature durability was poor. Further, the grain refining effect was insufficient, and caused multiple external appearance failures due to misruns in the blade parts. The casting yield was low accordingly.

In Comparative Example 12, the Cu composition was large, and multiple misruns occurred in the blade parts. The casting yield was low accordingly.

In Comparative Example 13, the Mg composition was large, and multiple misruns occurred in the blade parts. The casting yield was low accordingly.

In Comparative Example 14, the Fe composition was large, and the relationship chill temperature (° C.)<(plaster mold temperature−50) (° C.) was not satisfied. This resulted in a low proof stress value. Further, the presence of a coarse intermetallic compound caused cracks in the disc part, and the high-temperature durability was poor.

In Comparative Example 15, the Ni composition was large, and the proof stress value was low. Further, the presence of a coarse intermetallic compound caused cracks in the boss part, and the high-temperature durability was poor.

In Comparative Example 16, the Ti composition was large, and the relationship chill temperature (° C.)<(plaster mold temperature−50) (° C.) was not satisfied. As a result, the relationship Amax>Bmax>Cmax was not satisfied, and the presence of a coarse intermetallic compound caused cracks in the disc part, and the high-temperature durability was poor.

Second Example (Present Examples 9 to 14, and 16, and Comparative Examples 17 to 22)

Al alloys containing Cu: 2.6%, Mg: 1.6%, Ni: 1.1%, Fe: 0.9%, Ti: 0.15%, and the balance of Al and unavoidable impurities were used. Each Al alloy was melted in a common molten metal process, and the resulting molten metal was adjusted to the temperature shown in Table 3 by a molten metal preparation step. In the molten metal preparation step, 150 kg of the Al alloy was melted to obtain a molten metal. Thereafter, argon gas was blown into the molten metal for 20 minutes with a rotary gas blower operated at a rotation speed of 400 rpm, and a gas flow rate of 2.5 $Nm^3/h$. The whole molten metal was held still for 1 hour to remove the slag.

TABLE 3

| | Composition (mass %) | | | | | | | | | | Casting conditions | | | Heat treatment conditions | |
|---|---|---|---|---|---|---|---|---|---|---|---|---|---|---|---|
| | | | | | | | | | | | Molten metal temperature | Plaster temperature | Chill temperature | Solution treatment temperature × time | Aging treatment temperature × time |
| No. | Cu | Mg | Ni | Fe | Ti | Si | Zn | Mn | Cr | Al | (° C.) | (° C.) | (° C.) | (° C. × h) | (° C. × h) |
| Present Example 9 | 2.6 | 1.6 | 1.1 | 0.9 | 0.15 | 0.2 | 0.1 | 0.2 | 0.1 | Balance | 760 | 230 | 170 | 515 × 10 | 190 × 24 |
| Present Example 10 | | | | | | | | | | | 770 | 340 | 240 | 515 × 10 | 190 × 24 |
| Present Example 11 | | | | | | | | | | | 720 | 210 | 150 | 530 × 4 | 230 × 9 |
| Present Example 12 | | | | | | | | | | | 740 | 240 | 160 | 505 × 10 | 230 × 9 |
| Present Example 13 | | | | | | | | | | | 740 | 220 | 140 | 535 × 2 | 230 × 9 |
| Present Example 14 | | | | | | | | | | | 750 | 280 | 210 | 520 × 8 | 200 × 2 |
| Present Example 16 | | | | | | | | | | | 740 | 270 | 180 | 520 × 8 | 170 × 24 |
| Com. Ex. 17 | | | | | | | | | | | 770 | 360 | 200 | 520 × 6 | 200 × 16 |
| Com. Ex. 18 | | | | | | | | | | | 760 | 190 | 220 | 520 × 6 | 200 × 16 |
| Com. Ex. 19 | | | | | | | | | | | 740 | 280 | 90 | 520 × 6 | 200 × 16 |
| Com. Ex. 20 | | | | | | | | | | | 750 | 300 | 260 | 520 × 6 | 200 × 16 |
| Com. Ex. 21 | | | | | | | | | | | 760 | 250 | 190 | None | 190 × 24 |
| Com. Ex. 22 | | | | | | | | | | | 740 | 280 | 200 | 530 × 6 | None |

The Al alloy molten metal prepared in the molten metal preparation step was then subjected to low-pressure casting to produce an Al alloy casting, whereby the molten metal was pressure injected into a predetermined space configured from a plaster mold that had been adjusted to the preheating temperature shown in Table 3, and a copper chill disposed on the surface in contact with the impeller disc surface and that had been adjusted to the temperature shown in Table 3. The Al alloy casting was intended as a turbocharger compressor impeller for trucks, and had a shape with a boss part measuring 70 mm in height, a disc part measuring 80 mm in diameter, a blade parts measuring 60 mm in height and having 14 blades that were 0.4 mm in thickness at the blade tip. The molten metal was injected under 100 kPa pressure. This pressure was applied until the whole Al alloy casting completely solidified.

The Al alloy casting was removed from the plaster mold, and subjected to a solution treatment under the conditions shown in Table 3, and thereafter an aging treatment under the conditions of Table 3. In this way, a sample Al alloy cast impeller for compressors was prepared.

The samples prepared in such way were each evaluated for secondary dendrite arm spacing at the boss part, the blade parts, and the disc part, high temperature characteristics (0.2% proof stress value at 200° C., durability test evaluation), and productivity (casting yield evaluation) in the same manner as in First Example. The results are presented in Table 4.

was not satisfied. Further, damage occurred in the blade parts, and the high-temperature durability was poor. Further, the blade parts had multiple external appearance failures due to misruns, and the casting yield was low.

In Comparative Example 19, the chill temperature was low, and the disc part had a very small secondary dendrite arm spacing. This caused cracks in the disc part, and the high-temperature durability was poor. Further, the fast solidification caused multiple external appearance failures that involved cracking due to casting misruns, and the casting yield was low.

In Comparative Example 20, the chill temperature was high, and the relationship chill temperature (° C.)<(plaster mold temperature−50) (° C.) was not satisfied. The disc part thus had a large secondary dendrite arm spacing, and was damaged. The high-temperature durability was poor accordingly.

Comparative Examples 21 and 22 had low proof stress values because the solution treatment step was not performed in Comparative Example 21, and the aging treatment step was not performed in Comparative Example 22. The disc part was damaged, and high-temperature durability was poor.

TABLE 4

| | Secondary dendrite arm spacing | | | 0.2% proof stress | High-temperature | Productivity | | | |
|---|---|---|---|---|---|---|---|---|---|
| No. | Boss part (μm) | Blade part (μm) | Disc part (μm) | value at 200° C. (MPa) | durability test evaluation (Defect location)※1 | Evaluation of casting yield | Proportion of products with internal failure (%) | Proportion of products with misruns (%) | Proportion of products with shrinkage cavity failure (%) |
| Present Example 9 | 22 to 32 | 23 to 31 | 13 to 21 | 281 | Good | Good | 1.9 | 0.2 | 2.0 |
| Present Example 10 | 21 to 39 | 26 to 32 | 6 to 18 | 286 | Good | Good | 1.5 | 0.3 | 2.3 |
| Present Example 11 | 23 to 44 | 15 to 24 | 8 to 19 | 269 | Good | Good | 2.3 | 0.8 | 1.2 |
| Present Example 12 | 20 to 41 | 16 to 27 | 10 to 21 | 262 | Good | Good | 2.1 | 0.9 | 1.2 |
| Present Example 13 | 21 to 38 | 18 to 30 | 9 to 19 | 261 | Good | Good | 1.3 | 1.1 | 1.3 |
| Present Example 14 | 22 to 39 | 14 to 28 | 8 to 22 | 262 | Good | Good | 1.8 | 0.4 | 2.1 |
| Present Example 16 | 21 to 36 | 14 to 28 | 11 to 20 | 260 | Good | Good | 1.5 | 1.2 | 1.5 |
| Com. Ex. 17 | 36 to 52 | 30 to 41 | 15 to 24 | 251 | Poor (Boss part) | Acceptable | 6.3 | 0.4 | 2.3 |
| Com. Ex. 18 | 22 to 41 | 8 to 19 | 10 to 21 | 280 | Poor (Blade part) | Poor | 2.5 | 56.3 | 2.3 |
| Com. Ex. 19 | 25 to 40 | 20 to 29 | 4 to 13 | 278 | Acceptable (Disc part) | Poor | 1.5 | 38.1 | 4.1 |
| Com. Ex. 20 | 28 to 37 | 22 to 31 | 19 to 28 | 265 | Poor (Disc part) | Acceptable | 2.0 | 1.1 | 5.2 |
| Com. Ex. 21 | 23 to 37 | 16 to 28 | 10 to 19 | 116 | Poor (Disc part) | Good | 1.6 | 0.3 | 1.5 |
| Com. Ex. 22 | 23 to 40 | 22 to 30 | 12 to 20 | 133 | Poor (Disc part) | Good | 1.1 | 1.0 | 1.2 |

※1: 150,000 rpm × 200 hours, outlet temperature 200° C.

In Present Examples 9 to 14, and 16, the samples were cast under the appropriate conditions, and were satisfactory in terms of the secondary dendrite arm spacings of the boss part, the blade parts, and the disc part, the order of solidification, and the high-temperature proof stress value. These products were thus excellent in terms of casting yield and high-temperature durability.

In contrast, in Comparative Example 17, the plaster temperature was high, and the boss part and the blade parts had large secondary dendrite arm spacings. The proof stress value was low accordingly. Further, damage occurred in the boss part, and the high-temperature durability was poor.

In Comparative Example 18, the plaster mold temperature was low, and the relationship chill temperature (° C.)< (plaster mold temperature−50) (° C.) was not satisfied. The secondary dendrite arm spacing of the blade parts was therefore small, and the relationship Amax>Bmax>Cmax Third Example (Present Examples 20, 21, 24, 26, 27, and Comparative Examples 23 to 30)

Al alloys containing Cu: 2.9%, Mg: 1.7%, Ni: 1.1%, Fe: 1.1%, Ti: 0.17%, and the balance of Al and unavoidable impurities were used. Each Al alloy was melted in a common molten metal process, and the resulting molten metal was adjusted to the temperature shown in Table 5 by a molten metal preparation step. In the molten metal preparation step, 200 kg of the Al alloy was melted to obtain a molten metal. Thereafter, argon gas was blown into the molten metal for 40 minutes with a rotary gas blower operated at a rotation speed of 400 rpm, and a gas flow rate of 2.5 $Nm^3/h$. The whole molten metal was held still for 1 and half hour to remove the slag.

TABLE 5

| No. | Composition (mass %) | | | | | | | | | | Casting conditions | | | Heat treatment conditions | |
|---|---|---|---|---|---|---|---|---|---|---|---|---|---|---|---|
| | | | | | | | | | | | Molten metal temperature | Plaster temperature | Chill temperature | Solution treatment temperature × time | Aging treatment temperature × time |
| | Cu | Mg | Ni | Fe | Ti | Si | Zn | Mn | Cr | Al | (° C.) | (° C.) | (° C.) | (° C. × h) | (° C. × h) |
| Present Example 20 | 2.9 | 1.7 | 1.1 | 1.1 | 0.17 | 0.2 | 0.1 | 0.1 | 0.1 | Balance | 760 | 300 | 240 | 515 × 10 | 190 × 22 |
| Present Example 21 | | | | | | | | | | | 740 | 330 | 190 | 530 × 4 | 200 × 12 |
| Present Example 24 | | | | | | | | | | | 750 | 350 | 220 | 515 × 8 | 220 × 2 |
| Present Example 26 | | | | | | | | | | | 730 | 270 | 120 | 515 × 8 | 175 × 24 |
| Present Example 27 | | | | | | | | | | | 720 | 250 | 100 | 515 × 8 | 235 × 20 |
| Com. Ex. 23 | | | | | | | | | | | 785 | 300 | 200 | 530 × 4 | 195 × 18 |
| Com. Ex. 25 | | | | | | | | | | | 740 | 200 | 95 | 530 × 4 | 195 × 18 |
| Com. Ex. 26 | | | | | | | | | | | 750 | 250 | 255 | 530 × 4 | 195 × 18 |
| Com. Ex. 27 | | | | | | | | | | | 740 | 355 | 190 | 530 × 4 | 195 × 18 |
| Com. Ex. 28 | | | | | | | | | | | 750 | 195 | 200 | 530 × 4 | 195 × 18 |
| Com. Ex. 29 | | | | | | | | | | | 760 | 240 | 180 | None | 195 × 18 |
| Com. Ex. 30 | | | | | | | | | | | 750 | 250 | 210 | 530 × 4 | None |

The Al alloy molten metal prepared in the molten metal preparation step was then subjected to low-pressure casting to produce an Al alloy casting, whereby the molten metal was pressure injected into a predetermined space configured from a plaster mold that had been adjusted to the preheating temperature shown in Table 5, and a copper chill disposed on the surface in contact with the impeller disc surface and that had been adjusted to the temperature shown in Table 5. The Al alloy casting was intended as a turbocharger compressor impeller for ships, and had a shape with a boss part measuring 160 mm in height, a disc part measuring 150 mm in diameter, blade parts measuring 120 mm in height and having 16 blades that were 0.6 mm in thickness at the blade tip. The molten metal was injected under 100 kPa pressure. This pressure was applied until the whole Al alloy casting completely solidified.

The Al alloy casting was removed from the plaster mold, and subjected to a solution treatment under the conditions shown in Table 5, and thereafter to an aging treatment under the conditions of Table 5. In this way, a sample Al alloy cast impeller for compressors was prepared.

The samples prepared in such way were each evaluated for secondary dendrite arm spacing at the boss part, the blade parts, and the disc part, high temperature characteristics (0.2% proof stress value at 200° C., durability test evaluation), and productivity (casting yield evaluation) in the same manner as in First Example. The results are presented in Table 6.

TABLE 6

| No. | Secondary dendrite arm spacing | | | 0.2% proof stress | High-temperature | Productivity | | | |
|---|---|---|---|---|---|---|---|---|---|
| | Boss part (μm) | Blade part (μm) | Disc part (μm) | value at 200° C. (MPa) | durability test evaluation (Defect location)※1 | Evaluation of casting yield | Proportion of products with internal failure (%) | Proportion of products with misruns (%) | Proportion of products with shrinkage cavity failure (%) |
| Present Example 20 | 23 to 38 | 20 to 31 | 5 to 17 | 284 | Good | Good | 1.4 | 0.4 | 2.1 |
| Present Example 21 | 26 to 41 | 18 to 28 | 6 to 22 | 267 | Good | Good | 1.9 | 0.6 | 1.6 |
| Present Example 24 | 30 to 50 | 26 to 35 | 8 to 20 | 263 | Good | Good | 1.1 | 0.5 | 2.3 |
| Present Example 26 | 23 to 39 | 16 to 28 | 11 to 24 | 260 | Good | Good | 1.4 | 1.1 | 2.0 |
| Present Example 27 | 21 to 42 | 10 to 21 | 10 to 17 | 260 | Good | Good | 2.2 | 0.4 | 1.8 |
| Com. Ex. 23 | 38 to 51 | 28 to 40 | 20 to 28 | 248 | Poor (Boss part) | Acceptable | 5.5 | 0.8 | 3.1 |
| Com. Ex. 25 | 27 to 39 | 22 to 31 | 4 to 17 | 280 | Acceptable (Disc part) | Poor | 2.2 | 41.4 | 3.7 |
| Com. Ex. 26 | 30 to 41 | 27 to 35 | 22 to 30 | 259 | Poor (Disc part) | Acceptable | 3.0 | 1.0 | 4.8 |
| Com. Ex. 27 | 40 to 53 | 31 to 45 | 19 to 33 | 245 | Poor (Boss part) | Acceptable | 6.3 | 0.8 | 2.1 |

TABLE 6-continued

| No. | Secondary dendrite arm spacing: Boss part (μm) | Blade part (μm) | Disc part (μm) | 0.2% proof stress value at 200° C. (MPa) | High-temperature durability test evaluation (Defect location)※1 | Productivity: Evaluation of casting yield | Proportion of products with internal failure (%) | Proportion of products with misruns (%) | Proportion of products with shrinkage cavity failure (%) |
|---|---|---|---|---|---|---|---|---|---|
| Com. Ex. 28 | 28 to 37 | 9 to 20 | 13 to 21 | 263 | Acceptable (Blade part) | Poor | 4.1 | 33.5 | 2.2 |
| Com. Ex. 29 | 22 to 36 | 19 to 28 | 13 to 20 | 121 | Poor (Disc part) | Good | 1.3 | 0.4 | 1.1 |
| Com. Ex. 30 | 20 to 42 | 23 to 31 | 15 to 22 | 118 | Poor (Disc part) | Good | 1.5 | 0.8 | 1.0 |

※1: 150,000 rpm × 200 hours, outlet temperature 200° C.

In Present Examples 20, 21, 24, 26, and 27, the samples were cast under the appropriate conditions, and were satisfactory in terms of the secondary dendrite arm spacings of the boss part, the blade parts, and the disc part, the order of solidification, and the high-temperature proof stress value. These products were thus excellent in terms of casting yield and high-temperature durability.

In contrast, in Comparative Example 23, the molten metal temperature was high, and the secondary dendrite arm spacing was large in all portions. The proof stress value was low accordingly. Further, damage occurred in the boss part, and the high-temperature durability was poor.

In Comparative Example 25, the chill temperature was low, and the disc portion had a very small secondary dendrite arm spacing. This caused cracks in the disc part, and the high-temperature durability was poor. Further, the fast solidification caused multiple external appearance failures that involved cracking due to casting misruns, and the casting yield was low.

In Comparative Example 26, the chill temperature was high, and the relationship chill temperature (° C.)<(plaster mold temperature−50) (° C.) was not satisfied. The disc part thus had a large secondary dendrite arm spacing. The proof stress value was low. Further, damage occurred in the disc part, and the high-temperature durability was poor.

In Comparative Example 27, the plaster temperature was high, and the secondary dendrite arm spacing was large in all parts. This resulted in a low proof stress value. Further, damage occurred in the boss part, and the high-temperature durability was poor.

In Comparative Example 28, the plaster mold temperature was low, and the relationship chill temperature (° C.)<(plaster mold temperature−50) (° C.) was not satisfied. Accordingly, the blade parts had a small secondary dendrite arm spacing, and the relationship Amax>Bmax>Cmax was not satisfied. Further, cracking occurred in the blade parts, and the high-temperature durability was poor. The blade parts also had multiple external appearance failures due to misruns, and the casting yield was low.

Comparative Examples 29 and 30 had low proof stress values because the solution treatment step was not performed in Comparative Example 29, and the aging treatment step was not performed in Comparative Example 30. The disc part was damaged, and high-temperature durability was poor.

INDUSTRIAL APPLICABILITY

The present invention enables inexpensively providing an Al alloy impeller for compressors that has excellent high-temperature strength, and that can stably withstand the high temperatures of high-speed rotations over extended time periods. The present invention is also industrially very effective in that the output power of an internal combustion engine can be improved by increasing the supercharge ability of a turbocharger.

REFERENCE SIGNS LIST

1 Impeller for compressor
2 Boss part
3 Disc part
4 Blade part
5 Boss part DAS measurement cross section
6 Disc part DAS measurement cross section
7 Blade part DAS measurement cross section
8 Central shaft of compressor impeller

The invention claimed is:

1. A method for producing an impeller for compressors, the impeller being formed as an Al alloy casting, comprising a boss part, a plurality of blade parts, and a disc part, and having a 0.2% proof stress value of 260 MPa or more at 200° C., the method comprising:

preparing a 720 to 780° C. Al alloy molten metal that contains Cu: 1.4 to 3.2 mass %, Mg: 1.0 to 2.0 mass %, Ni: 0.5 to 2.0 mass %, Fe: 0.5 to 2.0 mass %, and Ti: 0.01 to 0.35 mass %, the balance of Al and unavoidable impurities;

pressure casting the Al alloy casting comprising:

pressure injecting the Al alloy molten metal resulting from said preparing into a product shape space configured from a plaster mold having a plaster mold temperature of 200 to 350° C., disposing a chill plate in contact with a disc surface of the Al alloy molten metal, and controlling a chill temperature of the chill plate to complete solidification first in the disc part, then the blade parts, and then the boss part, and to achieve a secondary dendrite arm distribution in which said maximum secondary dendrite arm spacing of the disc part is less than said maximum secondary dendrite arm spacing of the blade parts, and the maximum secondary dendrite arm spacing of the blade parts is less than the maximum secondary dendrite arm spacing of the boss part, said chill temperature being controlled to be greater than or equal to 110° C. and less than or equal to 250° C., the plaster mold temperature and the chill temperature satisfying the relationship chill temperature (° C.)<(plaster mold temperature−50) (° C.);

after said pressure casting, a solution treatment step of subjecting the Al alloy casting to a solution treatment; and an aging treatment step of subjecting the Al alloy casting to an aging treatment after the solution treatment.

2. The method for producing the impeller for compressors according to claim 1, wherein said pressure casting casts the boss part to measure 200 to 80 mm in height and have a secondary dendrite arm spacing of 20 to 50 μm, the disc part to measure 300 to 100 mm in diameter and have a secondary dendrite arm spacing of 5 to 25 μm, and the blade parts to include 30 to 10 blades measuring 180 to 60 mm in height, measuring 4.0 to 0.4 mm in thickness at a blade tip, and having a secondary dendrite arm spacing of 10 to 35 μm.

3. The method for producing the impeller for compressors according to claim 1, wherein said pressure casting casts the boss part to measure 100 to 20 mm in height and have a secondary dendrite arm spacing of 20 to 50 μm, the disc part to measure 120 to 25 mm in diameter and have a secondary dendrite arm spacing of 5 to 25 μm, and the blade parts to include 20 to 4 blades measuring 90 to 5 mm in height, measuring 3.0 to 0.1 mm in thickness at a blade tip, and having a secondary dendrite arm spacing of 10 to 35 μm.

4. The method for producing the impeller for compressors according to claim 1, wherein said controlling the chill temperature comprises controlling the chill temperature of the chill plate to be greater than or equal to 130° C. and less than or equal to 250° C.

* * * * *